US005961162A

United States Patent [19]

Gläser et al.

[11] Patent Number: 5,961,162

[45] Date of Patent: Oct. 5, 1999

[54] APPARATUS AND METHOD FOR MOUNTING LATCHING DEVICES

[75] Inventors: Gerald Gläser, West Malvern, United Kingdom; J. Thomas Weuthen, Erkelenz, Germany

[73] Assignee: Southco, Inc., Concordville, Pa.

[21] Appl. No.: 08/931,993

[22] Filed: Sep. 17, 1997

[51] Int. Cl.[6] ..... E05C 3/04

[52] U.S. Cl. ..... 292/198; 292/DIG. 53

[58] Field of Search ..... 292/63, 64, 67, 292/195, 198, DIG. 53; 70/79, 83, 451, DIG. 20; 403/197, 240, 187

[56] References Cited

U.S. PATENT DOCUMENTS

| | | | |
|---|---|---|---|
| 2,852,926 | 9/1958 | Chervenka . | |
| 3,241,874 | 3/1966 | Russell . | |
| 4,099,397 | 7/1978 | Davenbaugh | 70/371 |
| 4,186,952 | 2/1980 | Glass | 292/202 |
| 4,363,230 | 12/1982 | Lipschutz | 70/370 |
| 4,465,328 | 8/1984 | Tihanyi et al. . | |
| 4,556,244 | 12/1985 | Bisbing . | |
| 4,583,775 | 4/1986 | Bisbing . | |
| 4,763,935 | 8/1988 | Bisbing . | |
| 4,878,367 | 11/1989 | Bisbing . | |
| 4,930,822 | 6/1990 | Shen | 292/357 |
| 4,978,152 | 12/1990 | Bisbing . | |
| 5,165,738 | 11/1992 | McCormack . | |
| 5,678,437 | 10/1997 | Walla | 70/370 |

OTHER PUBLICATIONS

Trade literature, "Wooden Furniture Lock", Dzus Fasteners.

Southco Latches and Access Hardware, Handbook 43, 1993, Section E pp. E1–E13.

*Primary Examiner*—Steven Meyers
*Assistant Examiner*—Gary Estremsky
*Attorney, Agent, or Firm*—Paul & Paul

[57] ABSTRACT

A latch is mounted in an aperture in a door, panel or the like by first and second retaining members. The first retaining member limits rotational movement of the latch and the second retaining member limits axial movement of the latch.

18 Claims, 3 Drawing Sheets

APPARATUS AND METHOD FOR MOUNTING LATCHING DEVICES

BACKGROUND OF THE INVENTION

1. Field of the Invention

The present invention relates generally to latching devices and more particularly to latching devices for securing a first member such as a door, panel or the like in a closed position relative to a second member such as a corresponding door, panel or frame.

2. Brief Description of the Prior Art

Various types of latching devices for use in securing a first member such as a door, panel or the like in a closed position relative to a corresponding second member such as a door, panel or frame are known.

Some types are adapted to be mounted within an aperture provided through the first member, such as are disclosed in U.S. Pat. Nos. 4,978,152, 4,878,367, 4,763,935, 4,556,244 and 4,583,775, which are each assigned to Southco, Inc., the assignee of the present application. In each of these forgoing patents, mounting of the latch is accomplished through interaction of a flange or similar member on the latch against an outer surface of the first member adjacent to the respective aperture. For example, in U.S. Pat. No. 4,978,152, a slam-action latch is shown in FIG. 3 having an exterior mounting flange 24 in engagement with an outer surface of a door 15 when in the mounted position. Such types of devices have a disadvantage that they can not be used where flush mounting is desired. Another type of latch incorporates a flange or similar member which engages an inner surface of a door. However, such type of device has disadvantages that it can not readily be used with doors of varying thicknesses and also it requires that a specially configured shaped cavity be provided in the door which is time consuming to provide installation.

The present invention has been developed in view of the foregoing and to overcome the deficiencies of the prior art.

SUMMARY OF THE INVENTION

An object of the present invention is to provide a latch of the type mountable within an aperture of a first member such as a door, panel or the like, in which mounting can be accomplished without requiring that a flange or similar member of the latch engage a portion of the respective second member such as a door, panel or the like.

Another object of the present invention is to provide a latch of the type mounted within an aperture in a first member which is capable of being flush mounted with the outer surface of the first member.

Still another object of the present invention is to provide a latch capable of being flush mounted in panels of varying thicknesses.

Still another object of the present invention is to provide a latch that can be flush mounted in panels quickly.

The foregoing objects are accomplished by a latch comprising a housing and retaining means for securing the housing when the housing is received within an aperture provided within a door, panel or the like. The retaining means of the latch includes means for retaining both an axial position and a rotational position of the latch.

These and other objects of the present invention will become more readily apparent when taken into consideration with the following description and the attached drawings.

DETAILED DESCRIPTION OF THE PREFERRED EMBODIMENTS

The present invention is directed to an apparatus and method for mounting of latches, which have broad application and may be used in a wide variety of latches.

Illustrated in FIGS. 1–5 is one form of latch to which the apparatus and method for mounting of latches in accordance with the present invention may be applied. The particular latch shown in FIGS. 1–3 correspond to a latch shown, described and claimed in U.S. Pat. No. 4,583,775 referenced above entitled "Latch Assembly Having Pull-Up Action", which is incorporated by reference herein.

Figure 1:
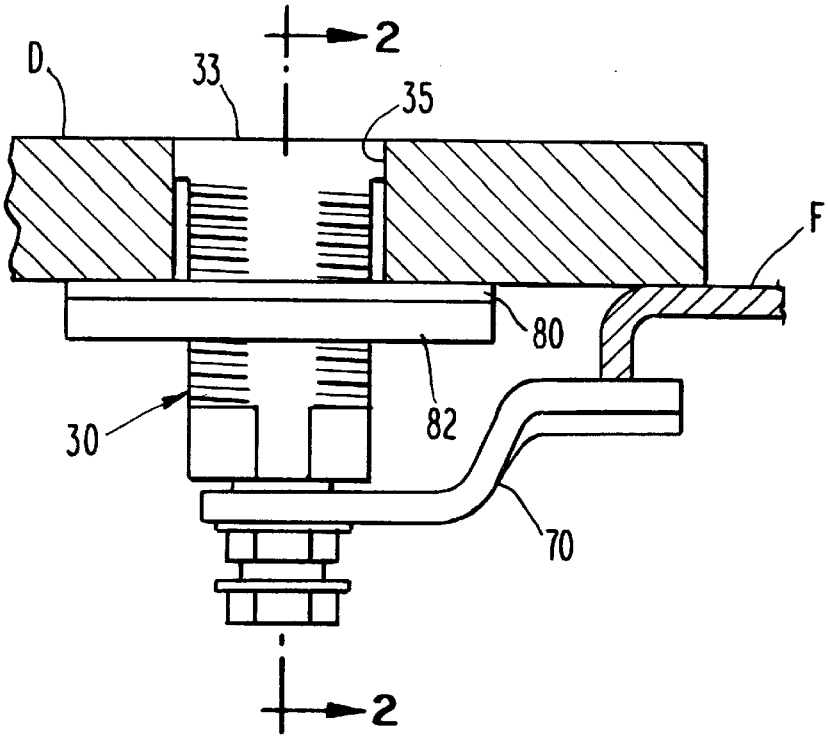
FIG. 1 is a front elevational view of a latch in accordance with an embodiment of the present invention.
Figure 2:
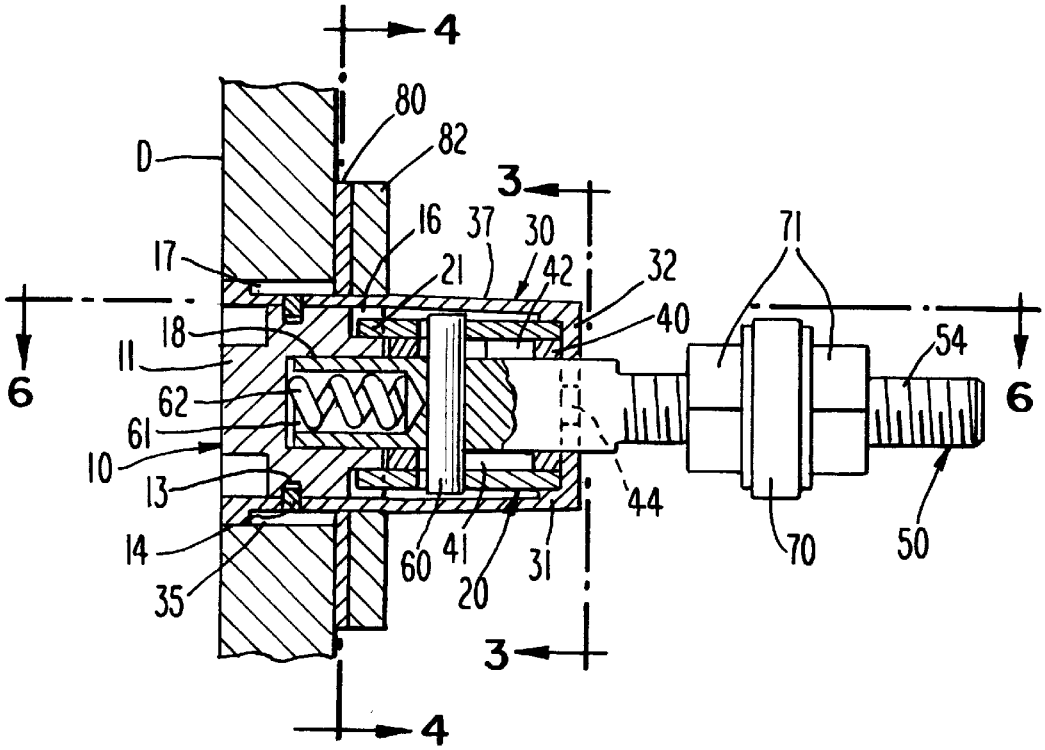
FIG. 2 is an elevational view, in section, looking along -he line 2—2 of FIG. 1.

In FIGS. 1 and 2, closure element D such as a door, panel or the like, has mounted thereon a latch mechanism having a housing 30, a shaft 50 having a threaded end 54 and a latching pawl 70 which is mounted on the threaded end of the shaft 50 as by nut 71, for adjustment in the axial direction of the shaft.

The latching pawl 70 is movable rotationally by shaft 50 and is also moveable by shaft 50 axially in the longitudinal direction of the shaft. To latch the closure element D to the frame F, the latching pawl 70 is first rotated to a position such that it is in line with the frame member F. The latch assembly is then moved longitudinally so that it engages the edge of the frame F. The shaft 50 is moved rotationally and also longitudinally by means of a rotatable actuator 10. In the present embodiment, the rotatable actuator 10 comprises a drive plug shown to have a square shaped driver 11 for receiving a correspondingly shaped recess of a drive tool. The driver 11 and corresponding recess could, of course, have other shapes; for example, hexagonal or octagonal. Further, the positions of the driver 11 and recess can be switched or the driver 11 can be provided in other forms, such as a cap or handle.

The plug 10 is generally cylindrical and has a cylindrical bore 18 which receives the outward end of the shaft 50. The plug 10 is rotatable within the housing 30 and is prevented from movement in the axial direction of shaft 50 by a retaining ring 14 which is received within grooves 13 located in registered positions in plug 10 and housing 30. The inward end of the plug 10 is provided with a pair of notches 16 which receive ears 21 which project axially outwardly from a sleeve-like cam 20. Thus, when plug 10 is rotated, as by a suitable tool, the sleeve-like cam 20 is also rotated. The plug 10 and cam 20 may also be provided as one piece.

The sleeve-like cam 20 is provided with at least one and, in the present embodiment, a pair of cam slots 25 spaced 180° apart circumferencially. Each of the slots 25 run in a direction which has both circumferencial and axial components.

Positioned coaxially between shaft 50 and the sleeve-like cam 20 is a fixed motion control sleeve 40 having a pair of axial slots 41 and a pair of lateral or circumferencial slots 42. In the present embodiment, one slot of each pair is spaced 180° from the other. The inward end of each axial slot connects with one end of one of the circumferencial slots. The motion control sleeve 40 is prevented from moving rotationally relative to housing 30 by a pair of ears 44 which project axially inwardly into slots in the inward end 32 of the housing 30. The fixed motion control sleeve 40 may also be provided integral with the housing 30 being formed directly within or extending from an inner surface of the housing 30. The pair of slots 41 and 42 in the motion-control sleeve 40 function respectively as axial motion-control slots and as lateral motion-control slots.

Figure 5:
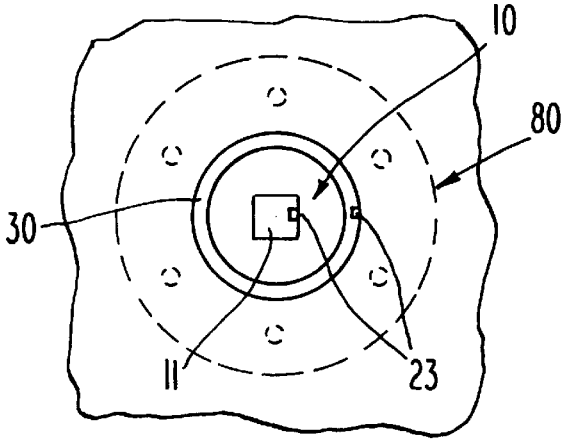
FIG. 5 is a top plan view of the latch of FIG. 1.

The housing 30 in the present embodiment is a generally elongate component defined by an upper end, a lower end, an opening extending longitudinally through the housing 30 and an outer surface. The lower end 32 of housing 30 is closed except for a central opening through which shaft 50 passes. In the present embodiment, the inward ends of the motion-control sleeve 40 and sleeve-cam 20 abut against the inward end 32 of the housing 30. The plug 10 is positioned within the opening through the housing 30 adjacent to the upper end 33 of the housing 30. In the present embodiment, the plug 10 is confined within the housing 30 so that no portion of the plug 10 will extend out from the housing 30 passed the upper end 33. The outer surface of the housing 30 includes a first portion 35 adjacent to the upper end 33 and which is substantially circular in cross-section. The outer surface of the housing 30 as best shown in the bottom plan view of FIG. 3 also includes a second portion 37 which is non-circular in cross-section. In the present embodiment, the cross-sectional shape of a second portion 37 of the housing 30 can best be described as a square having a radius at each of the four corners. However, it should be understood that the cross-sectional shape of the second portion 37 of housing 30 can be of any desired configuration. In addition, in the present embodiment as illustrated in FIG. 1, the second portion 37 of housing 30 is further provided with a section having a series of threads provided within the outer surface and located at each of the four radiused portions (only two of which are visible), the purpose of which will be described below. Further, in the present embodiment, the plug 10 and first portion 35 of housing 30 are provided with corresponding notches 23 which operate as an indicator of the position of the pawl 70, as best seen in FIG. 5.

As best illustrated in FIG. 2, shaft 50 is an elongated shaft, the outer or head end of which is received within the cavity of bore 18 in the plug 10. Shaft 50 projects inwardly through the hole and the inward end 32 of housing 30 and beyond, with the shaft so supported that the center axis of the shaft coincides with the center axis of motion-control sleeve 40 and cam 20. The inner end 54 of shaft 50 is threaded, and thereon is mounted a latching pawl 70, with the position of the pawl on the shaft being held in place by a pair of nuts 71 and be axially adjustable.

The relative positions of the motion-control sleeve 40 and cam 20 could be reversed. That is, motion-control sleeve 40 could be readily outside of cam 20 rather than within as shown.

Mounted on the shaft 50 is the cross-pin 60 which projects laterally in both directions from the shaft and functions as both a cam follower and as a motion-control pin.

Figure 6:
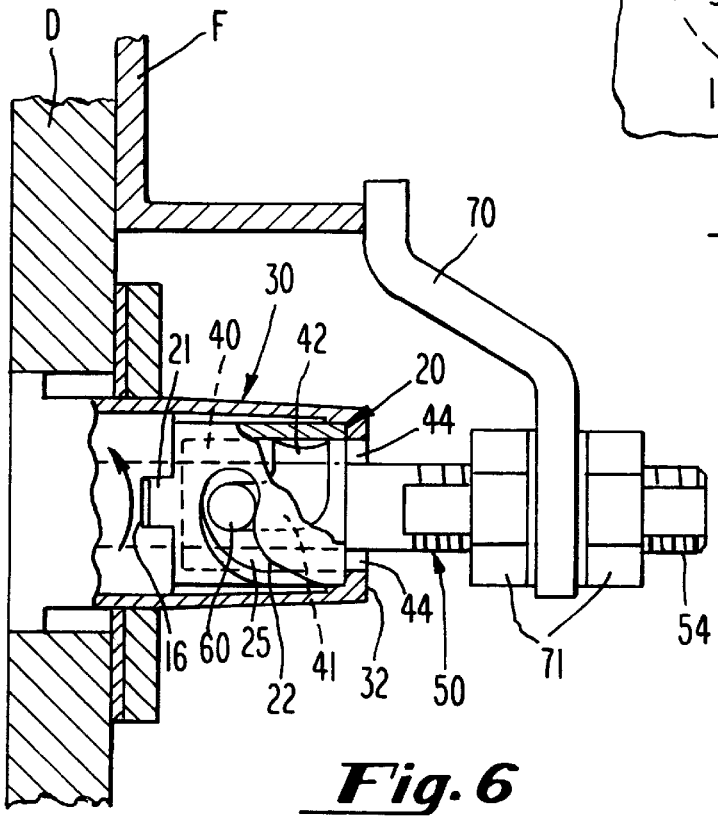
FIG. 6 is a view, partly in section, showing the latch mounted on the door of the cabinet and in fully latched position.

The outward end of shaft 50 is provided with a center bore 61 in which a coil compression spring 62 is placed. The outward end of compression spring 62 bears against the plug 10. Thus, compression spring 62 biases shaft 50 inwardly toward the unlatching position. This biasing force maintains the ends of cross pins 60 in close contact with the inner wall 22 of cam slot 25 as best illustrated in FIG. 6. The biasing spring 62 is desirable but not essential since even without the spring, the ends of the cross-pins 60 would follow the cam slots 25. However, the cam slot 25 has a width which is somewhat greater than the diameter of the cross-pin 60 and accordingly the biasing spring is useful in maintaining the cross pin against the inward wall of the slots. Cross-pin 60 controls whether, in response to rotation of the plug 10, shaft 50 and pawl 70 will move only axially or only angularly. This is determined by whether the opposite ends of pin 60 are within the axial motion-control slots 41 or in the lateral motion control slots 42. In another embodiment, the plug 10, cam 20 and shaft 50 can be provided as a single piece.

The housing 30 is mounted on the closure member D by retaining means which, in the present embodiment, is comprised of a first retaining member comprising a retaining washer 80 and a second retaining member comprising a separate retaining nut 82. As best shown in the top plan views of FIGS. 4 and 5, the retaining washer 80 is provided with a generally circular shaped circumference and includes an opening 83 therein preferably corresponding in shape to the cross-sectional shape of the second portion 37 of the housing 30, which is non-circular in the present embodiment. Further, in the present embodiment the retaining washer 80 may also be included with at least one mounting hole therethrough. In the present embodiment, the retaining washer 80 is provided with six mounting holes therethrough substantially circular in shape and equally spaced around the circumference.

Figure 3:
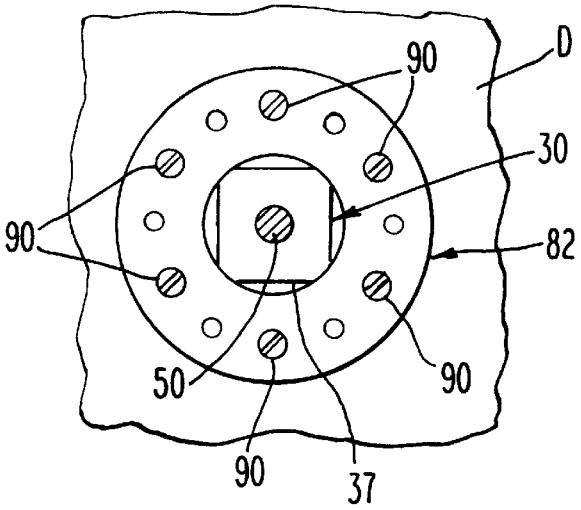
FIG. 3 is a bottom plan view of the latch looking along the line 3—3 of FIG. 2.
Figure 4:
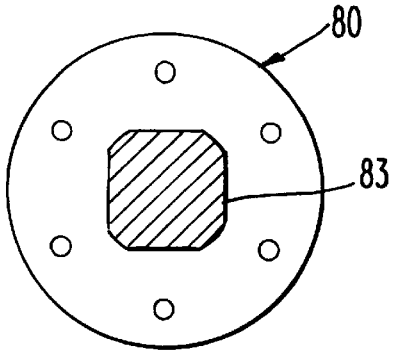
FIG. 4 is a top plan view, in section, looking along the line 4—4 of FIG. 2.

The retaining nut 82 in the present embodiment as best seen in FIG. 3 is also generally circular in its circumference and of the same diameter as the retaining washer 80. The retaining nut 82 in the present embodiment is provided with a circular opening therethrough defining an inner wall having a series of threads formed therein (not shown). Further, the retaining nut 82 may also be provided with at least one mounting hole extending therethrough and in the present embodiment there are twelve equally spaced circular holes extending around its circumference.

In the present embodiment, the housing 30 can be mounted by inserting the latch into the aperture in one of two ways. For instance, the latch can be inserted in an outward direction with the upper end 33 of the housing 30 being inserted first into the aperture in the closure member D. Alternatively, the latch can be inserted in an inward direction with its opposite end 32 first being inserted into the aperture in the closure D, which is most easily accomplished when the pawl 70 is not mounted on the shaft 50, so that the shaft 50 can be inserted first through the aperture in the closure member D, however, such is not required.

The next step is to secure the housing 30 by the retaining washer 80 and retaining nut 82. The retaining washer 80 and retaining nut 82 are each received onto the second portion 37 of the housing 30, which is accomplished in the present embodiment from the lower end 32 of the housing 30. In this embodiment, there is a choice as to when the retaining washer 80 and retaining nut 82 are placed onto the housing 30. For instance, where the upper end 33 of the housing 30 is inserted first into the aperture of the closure member D, the retaining washer 80 and retaining nut 82 can already be in position on the housing 30 prior to insertion of the latch into the aperture, or alternatively the retaining washer 80 and retaining nut 82 can be inserted onto the housing 30 after the latch is in position within the aperture within the closure member D. However, where the latch is inserted in an inward direction with the lower end 32 of the housing 30 first being inserted into the aperture in closure member D, the retaining washer 80 and retaining nut 82 can only be mounted on the housing 30 after the latch has been positioned within the aperture of the closure member D.

The housing 30 is secured within the aperture of the closure member D in a position shown in FIG. 1 by the combination of the retaining washer 80 and retaining nut 82. The shape of the opening through the retaining washer 80 and cross-sectional shape of the second portion 37 of the housing 30 allow the retaining washer 80 to be moved axially along the longitudinal direction of the housing 30 but not rotationally. The retaining nut 82 can be moved axially along the longitudinal direction of the housing 30 upon rotation due to the engagement of the threads in the inner wall of the retaining nut 82 with the threads formed in the outer surface of second portion 37 of housing 30. The retaining washer 80 and retaining nut 82 can be moved either separately or together in a longitudinal direction of housing 30. In the present embodiment, when the upper end of the housing 30 is in a flush position relative to the outer surface of the closure member D, the retaining washer 80 and retaining nut 82 are each in a position along the longitudinal direction of the housing 30 so as to engage the inner surface of the closure member D. From this particular position of the retaining washer 80 and retaining nut 82, rotational movements of the latch are prevented by the retaining washer 80 and axial or longitudinal movement of the latch, such as in a direction of either the inner surface or outer surface of the closure member D, is prevented by the retaining nut 82.

In addition, as an additional reinforcement, a fastening member such as the six screws 90 can be inserted through the mounting holes of the retaining washer 80 and retaining nut 82 when aligned and then secured to the closure member D, such is illustrated in FIG. 3. As should be understood, any number of screws or other types of fastening members can be utilized for this purpose. For example, the retaining washer 80 can include at least one portion, such as a tab, which is adapted to be received into either the inner surface of the closure member D or inner diameter of the aperture of the closure member D, such as by spurs extending from the tab.

In the present embodiment, the components of the latch are preferably comprised of metal and metal alloy materials, however, other suitable materials can also be used where desired. In addition, in the present embodiment, closure member D is comprised of wood, however, the closure D can also be comprised of other materials, such as metal, and of varying thicknesses.

The operation of the latch when in a mounted position will now be described.

As seen best in FIGS. 1 and 2, when plug 10 is rotated, as by a tool, the sleeve-like cam 20 will be driven rotationally due to the projection of cam ears 21 into the notches 16 in plug 10. When cam 20 is rotated, cross pin 60 is moved, but whether the movement is axial or lateral is dependent upon whether the ends of pin 60 are in the axial or lateral slots of the motion-control sleeve 40.

In FIG. 6 the latch is shown in the fully latched position in which the latch pawl 70 is in alignment with, and in engagement with, the cabinet frame F. When in the latched position, plug 10 is at its fully clockwise position, as viewed looking from the left in FIG. 6 and the two opposite ends of cross pin 60 project through the axial slots 41 in the motion-control sleeve 40 and into the closed outmost ends of cam slots 25.

To unlatch the closure member D from the cabinet frame F, plug 10 is turned in the counterclockwise direction in the direction of the arrow shown in FIG. 6. When this is done, plug 10 and cam 20 rotate as a unit. The cross pin 60 cannot move rotationally because its opposite ends are within the diametrically-opposed axial slots 41 of the fixed motion-control sleeve 40. As a result, when cam 20 is rotated counterclockwise, the force of the biasing spring 62 causes the opposite ends of pin 60 to follow the inward walls 22 of the opposed cam slots 25, and, as a result, pin 60, and hence also shaft 60 and latch pawl 70, move in the inward unlatched direction until the ends of the pin 60 reach the lateral slots 42.

Figure 7:
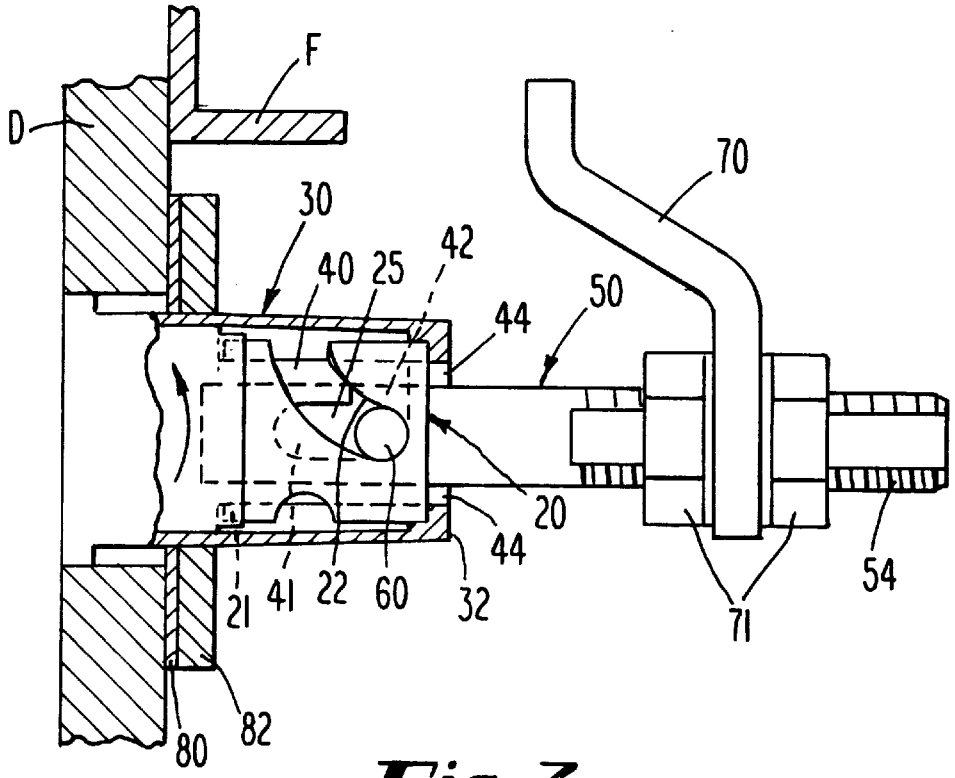
FIG. 7 is a view similar to that of FIG. 6 but showing the latch in partly unlatched position.
Figure 8:
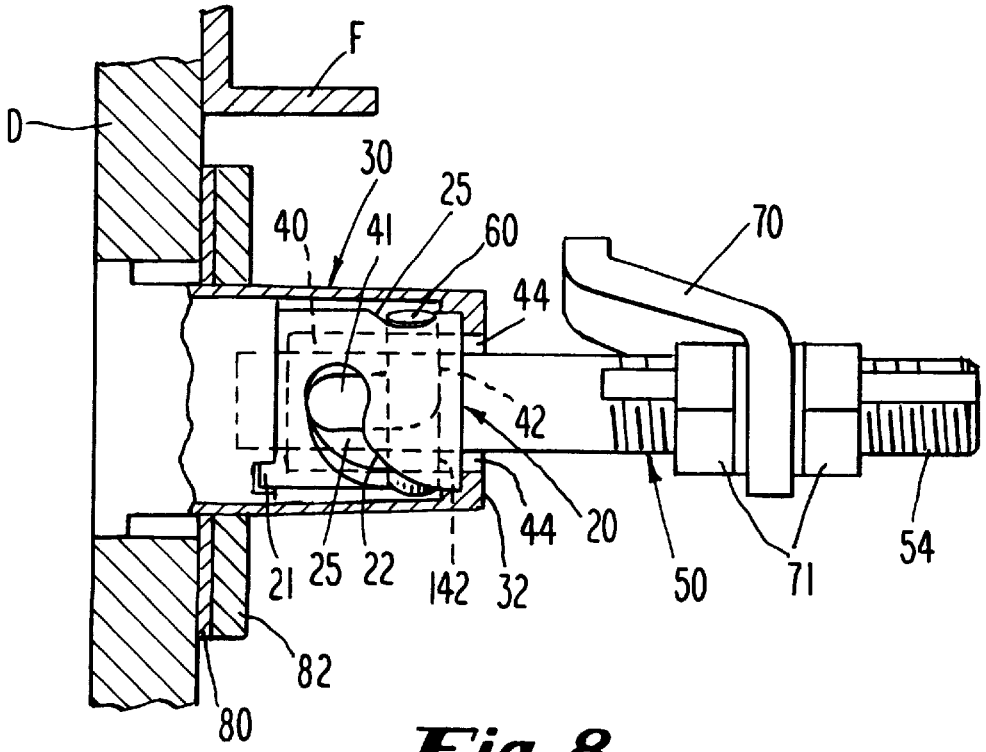
FIG. 8 is a view similar to that of FIGS. 6 and 7 but showing the latch in fully unlatched position.

After plug 10 and cam 20 have been rotated as a unit through 120° from the position shown in FIG. 6, cross pin 60 has moved axially inwardly to the position shown in FIG. 7, and is now aligned with the opposed lateral slots 42. Further rotation of plug 10 and cam 20 now causes rotational movement of cross pin 60, shaft 50 and pawl 70, as the opposed ends of pin 20 move into the opposed lateral slots 42. In this manner, pawl 70 is moved out of alignment with frame member F and, after 60 degrees of rotation, the door D is fully unlatched, as is illustrated in FIG. 8. Plug 10 is now 180° from the fully latched position shown in FIG. 6.

The latching action is simply the reverse of the unlatching action which has just been described. On latching, as plug 10 is turned clockwise, the opposite ends of cross pin 60 move laterally in the lateral slots 42 and shaft 50 rotates on its axis. Then the cross pin 60 translates axially outwardly. These sequential motions are caused by the walls 22 of the cam slots 25 which urge the ends of the cross pin 60 through the lateral motion-control slots 42 in the lateral or circumferencial direction until the ends of the cross pin abut against the edge of the axial motion-control slots 41. Thereafter, walls 22 of the cam slots 25 urge the ends of the cross pin 60 axially outwardly through axial slots 41. Thus, cam 20 and the motion-control slots 41 cause the angular and axial motions to take place in sequence, in response to turning the plug 10 in the latching direction in one continuous motion.

The new latch has been described as mounted on the movable door. This is the preferred location. However, a latch embodying the basic concept of the present invention could be mounted on the fixed cabinet rather than on the door. In such case, the shaft and latch pawl would be moved angularly to engage a keeper mounted on the inside of the door and then axially inwardly to pull the door to tightly closed position. This is the reverse of the axial motion used to pull the door tightly shut when the latch is mounted on the door.

It will be recognized by those skilled in the art that changes may be made by the above-described embodiments of the invention without departing from the broad inventive concept thereof. For example, the positions of the retaining washer 80 and retaining nut 82 may be reversed on the housing 30, so that the retaining nut 82 is positioned closest to the lower end 32 of the housing 30. In addition, the configuration of the retaining washer 80 and retaining nut 82, while each circular in circumference in the present embodiment, can be provided in other shapes as well; for example, the retaining nut 82 and/or the retaining washer 80 may be square shaped. Further, while the retaining washer 80 and retaining nut 82 are shown abutting one another when mounted, it should be understood that the retaining washer 80 and retaining nut 82 may also be spaced from one another when in the mounted position. Additionally, the first portion 35 of the housing 30, which is shown substantially circular in cross-section and of a diameter larger than that of the second portion 37, can be provided of other cross-sectional shapes and diameters; for example, the diameter of the first portion 35 can be the same as that of the second portion 37 of housing 30. It is understood, therefore, that this invention is not limited to the particular embodiments disclosed, but it is intended to cover all modifications which are within the scope and spirit of the invention as defined by the appended claims.

We claim:

1. A latch comprising:

a housing generally elongate in an axial direction; and first and second retaining members on said housing and with said first and second retaining members having mounting and mounted positions, wherein said first and second retaining members are movable in said mounting position and substantially fixed in said mounted position;

said first retaining member received onto said housing for axial movement relative to said housing in said mounting position;

means between said first retaining member and said housing for substantially preventing rotational movement of said first retaining member relative to said housing in said mounting position;

said second retaining member received onto said housing for rotational movement relative to said housing in said mounting position;

means between said second retaining member and said housing for limiting axial movement of said second retaining member relative to said housing in said mounting position; and means for connecting said first and second retaining members for substantially preventing relative movement of either member in said mounted position.

2. A latch according to claim 1, wherein said first retaining member comprises a retaining washer having a non-circular shaped aperture therethrough received onto at least a portion of an outer surface of said housing having a non-circular shaped cross-section.

3. A latch according to claim 2, wherein said second retaining member comprises a retaining nut having a substantially circular aperture therethrough defining an annular wall having a series of threads thereon and received onto at least a portion of said outer surface of said housing having a series of corresponding threads from therein.

4. A latch according to claim 1, wherein said connecting means comprises said first retaining member and said second retaining member each further comprising at least one mounting hole therethrough receiving a fastening member in said mounted position.

5. A latch according to claim 1, wherein said housing defines an upper end, a lower end and an opening therein, wherein said latch further comprises:

an elongated shaft received within at least a portion of said opening within said housing for either rotational or axial movements; and means between said housing and said shaft for imparting either rotational or axial movement to said shaft.

6. A latch according to claim 5 further comprising an actuating member received within said opening within said housing.

7. A latch according to claim 6, wherein said means for imparting either rotational or axial movement to the shaft comprises a cam having at least one cam slot coupled to said actuating member and contained within said support base for rotatable movement, and at least one cross-pin associated with said shaft extending within said at least one cam slot.

8. A latch according to claim 7, wherein said means for imparting either rotational or axial movement to the shaft further comprises at least one axial surface defining an axial slot fixed relative to said support base, wherein one cross pin of said at least one cross pin engages said axial surface for limiting rotational movement of said shaft.

9. A latch according to claim 8, wherein said means for imparting either rotational or axial movement to the shaft further comprises at least one lateral surface defining a lateral slot fixed relative to said support base and intersecting said at least one axial slot.

10. A latch according to claim 9 further comprising biasing means for biasing said shaft in one direction for maintaining said at least one cross pin in engagement with a wall of said at least one cam slot.

11. A latch according to claim 10, wherein said cam comprises two cam slots and said at least one cross pin extends within each of said two cam slots, and wherein said means for imparting either rotational axial movement to the shaft comprises two diametrically opposing axial surfaces defined two diametrically opposing axial slots and two diametrically opposing lateral surfaces defining two diametrically opposing lateral slots.

12. A latch according to claim 11 further comprising a pawl mounted to said shaft.

13. In combination, a latch and retainer assembly comprising:

a first retaining member having an aperture therethrough defining at least one retaining surface and encircling a first portion of said latch, wherein said first portion of said latch in cross-section comprises a latch retaining, surface substantially corresponding in configuration to said at least one retaining surface of said aperture of said first retaining member, whereby said first retaining member is adjustable in a longitudinal direction of said first portion of said latch and substantially fixed against rotation relative to said first portion of said latch; and a second retaining member having a threaded aperture therethrough and encircling a second portion of said latch having a threaded outer surface, whereby said second retaining member is rotatable relative to said second portion of said latch for adjusting a position of said second retaining member in a longitudinal direction of said second portion of said latch, wherein said first and second retaining members each include at least one mounting hole therethrough and said retainer assembly further includes at least one fastening member extending through said at least one mounting hole of said first and second retaining members.

14. A combination according to claim 13, wherein said first and second retaining members each include a plurality of mounting holes therethrough and said retainer assembly includes a plurality of fastening members extending through said plurality of mounting holes of said first and second retaining members.

15. In combination, a latch and retainer assembly comprising:

a first retaining member having an retaining aperture therethrough defining at least one retaining surface and encircling a first portion of said latch, wherein said first portion of said latch in cross-section comprises a latch retaining surface substantially corresponding in configuration to said at least one retaining surface of said retaining aperture of said first retaining member, whereby said first retaining member is adjustable in a longitudinal direction of said first portion of said latch and substantially fixed against rotation relative to said first portion of said latch; and a second retaining member having a threaded aperture therethrough and encircling a second portion of said latch having a threaded outer surface, whereby said second retaining member is rotatable relative to said second portion of said latch for adjusting a position of said second retaining member in a longitudinal direction of said second portion of said latch, wherein said retaining aperture of said first retaining member is substantially non-circular in configuration and said first portion of said housing in cross-section is configured substantially corresponding to said non-circular aperture of said first retaining member said first retaining member further comprising at least one mounting aperture and said retainer assembly further comprising a fastener member adapted to extend through said mounting aperture to be secured to a panel for substantially fixing an axial position of said first retaining member.

16. In combination, a latch and retainer assembly comprising:

a first retaining member having a retaining aperture therethrough defining at least one retaining surface and encircling a first portion of said latch, wherein said portion of said latch in cross-section comprises a latch retaining surface substantially corresponding in configuration to said at least one retaining surface of said retaining aperture of said first retaining member, whereby said first retaining member is adjustable in a longitudinal direction of said first portion of said latch and substantially fixed against rotation relative to said first portion of said latch; and a second retaining member having a threaded aperture therethrough and encircling a second portion of said latch having a threaded outer surface, whereby said second retaining member is rotatable relative to said second portion of said latch for adjusting a position of said second retaining member in a longitudinal direction of said second portion of said latch, wherein said first retaining member engages said second retaining member said second retaining member further comprising at least one mounting aperture and said retainer assembly further comprising a fastener member adapted to extend through said mounting aperture to be secured to a panel for substantially fixing an axial position of said second retaining member.

17. A method for mounting a latch in a panel, the panel having an outer surface, an inner surface and an aperture therethrough, said method comprising the steps of:

providing a latch comprising a first retaining member having an aperture therethrough defining at least one retaining surface, a second retaining member having a threaded aperture therethrough and a housing having an upper end, a lower end and an outer surface, with said outer surface having a first portion defining a substantially threaded section and a second portion defining a latch retaining surface having a cross-section substantially corresponding in configuration to said at least one retaining surface of said first retaining member; and installing said latch in said panel comprising:

inserting at least said outer surface of said housing into said aperture of said panel;

inserting said first retaining member on said latch so that said aperture of said first retaining member substantially encircles said housing;

inserting said second retaining member on said latch so that said threaded aperture of said second retaining member substantially encircles and engages said threaded section of said housing;

adjusting a position of said first retaining member and said second retaining member relative to said upper end of said housing by rotating said second retaining member and sliding said first retaining member in a substantially axial direction so that said at least one retaining surface of said first retaining member is adjacent said retaining surface of said housing;

providing said first retaining member and second retaining member each having at least one aperture therethrough;

providing a generally elongate fastening member;

inserting said generally elongate fastening member through said at least one aperture of said first retaining member and said second retaining member; and securing said generally elongate fastening member to said panel.

18. A method according to claim 17 further comprising the steps of:

providing said second portion of said housing having a cross-section substantially corresponding in configuration to said aperture of said first retaining member;

providing a plurality of apertures through each of said first retaining member and said second retaining member and a plurality of generally elongate fastening members;

inserting said plurality of generally elongate fastening members through said plurality of apertures of said first retaining member and said second retaining member; and securing said generally elongate fastening members to said panel.

* * * * *